US005266966A

United States Patent [19]

Fushimi et al.

[11] Patent Number: 5,266,966

[45] Date of Patent: Nov. 30, 1993

[54] THERMAL PRINTER HAVING A THERMAL LINE HEAD POSITIONING MECHANISM

[75] Inventors: Kazuhiro Fushimi; Satoru Watanabe; Kazuaki Sugimoto, all of Shizuoka, Japan

[73] Assignee: Tokyo Electric Co., Ltd., Tokyo, Japan

[21] Appl. No.: 981,359

[22] Filed: Nov. 25, 1992

[30] Foreign Application Priority Data

Nov. 28, 1991 [JP] Japan ..... 3-98206
Nov. 29, 1991 [JP] Japan ..... 3-98974

[51] Int. Cl.[5] ..... B41J 25/304; B41J 2/325

[52] U.S. Cl. ..... 346/76 PH; 400/120; 400/55

[58] Field of Search ..... 346/76 PH; 400/120, 400/120 HE, 55, 56, 57

[56] References Cited

FOREIGN PATENT DOCUMENTS 0447162 9/1991 European Pat. Off. ..... 400/55
0161162 8/1985 Japan ..... 400/120

*Primary Examiner*—Benjamin R. Fuller
*Assistant Examiner*—Huan Tran
*Attorney, Agent, or Firm*—Oblon, Spivak, McClelland, Maier & Neustadt

[57] ABSTRACT

A bracket is provided which is supported by a shaft so as to be freely rotatable between a pair of supporting frames, a line head is fixed on the bracket through an elastic member, a platen is disposed in a position opposing to a heating element array of the line head and is capable of freely approaching to or receding from the platen, engaging holes are formed on a supporting frame, an engaging claw to be engaged with the engaging hole is formed on the bracket, and the pressing force of the line head toward the platen is varied in several steps by holding the bracket stepwise.

7 Claims, 7 Drawing Sheets

THERMAL PRINTER HAVING A THERMAL LINE HEAD POSITIONING MECHANISM

BACKGROUND OF THE INVENTION

1. Field of the Invention

The present invention is related to thermal printers to be utilized for label printers, etc.

2. Description of the Related Art

At present, various kinds of printers are actually used, and thermal printers which are able to perform image printing quietly and have simple constitutions are utilized as label printers, etc., for example.

In a thermal printer as mentioned in the above, a line head is fixed to be capable of freely approaching to or receding from a platen to be able to mount a recording medium such as a label sheet.

In such a thermal printer, it is desired to make the pressure of a line head toward a platen variable to keep good printing quality even if the thickness of a recording medium is varied. There is an apparatus disclosed in a Japanese Patent Laid-Open No. Hei 1-8055 by the present applicant as a thermal printer in which such a mechanism as described in the above is realized.

A thermal printer of such a constitution will be explained referring to an example based on FIG. 9. In a label printer 1, a thermal printer as mentioned in the above, a platen roller 3 is supported by its shaft to be freely rotatable between a pair of supporting frames 2, and a line head 4 having heating elements (not shown in a drawing) on the surface being capable of freely approaching to or receding from the platen 3, together with a bracket 5, are supported to be freely slidable between a pair of supporting frames 2. In the label printer 1, a polygon cam 8, a variable pressure mechanism arranged to be freely rotatable being connected to a control lever 6 through a rotary shaft 7 outside the supporting frame 2 is abutting the bracket 5 from the upper side, and the bracket 5 is connected to the line head 4 through an elastic body, a spring (not shown in a drawing). In the label printer 1, the supporting frame 2, the control lever 6, etc. mentioned in the above are housed in a main body housing (not shown in a drawing).

In the label printer 1 having a constitution as mentioned in the above, a spring under the bracket 5 being positioned and held with the polygon cam 8 is pressing the line head 4 toward the platen roller 3; thereby, image printing is performed on a recording medium (not shown in a drawing) such as a thermosensible paper conveyed onto the platen roller 3 by heating scanning of the line head 4.

In the label printer 1, the thickness of a label sheet and that of a tag sheet, for example, to be utilized as recording media are different from each other; thereby, it is necessary to adjust the pressing force between the line head 4 and the platen roller 3 corresponding to the thickness of a recording medium. In the label printer 1, the pressing force of a line head 4 acting toward the platen roller 3 is made variable with the action of a spring under the bracket 5 in displacing the position of the bracket 5 relative to the supporting frame 2 stepwise in rotating the polygon cam 8 by manually operating the control lever 6.

In the label printer 1, the pressing force of the line head 4 toward the platen roller 3 can be varied by rotating the polygon cam 8 positioned on the bracket 5 which presses a spring against the line head 4. Therefore, there is the polygon cam 8 placed on the bracket 5, and the receding dimension of the line head 4 from the platen roller 3 is limited. Because of this, there is a problem that when a recording medium is loaded, the loading work is made difficult by the small space.

It is difficult to securely position and hold the bracket 5 being energized with a spring by the polygon cam 8, and there is a fear that the polygon cam 8 may be rotated by vibration, etc. and the bracket 5 can be displaced.

Moreover, in the label printer as described in the above, the control lever 6 is fixed on the rotary shaft 7 and is installed so as to penetrate the supporting frames 2 for rotating the polygon cam 8, so that the length of the rotary shaft 7 in the direction of the axis has to be longer than that of the line head 4, which prevents the label printer 1 from being small in size and light in weight.

SUMMARY OF THE INVENTION

A first object of the present invention is to obtain a thermal printer in which a recording medium such as a label sheet can be loaded easily.

A second object of the present invention is to simplify the fixing of a line head facing a platen.

A third object of the present invention is to perform a good quality image printing on recording media of different thickness dimensions.

In the present invention, a bracket is provided being supported to be freely rotatable by the shaft between a pair of frames, a line head is fixed on the bracket through an elastic member, a platen is disposed in a position opposing to the heating element array of the line head being capable of freely approaching to or receding from the platen, engaging holes are formed on a supporting frame, and an engaging claw to be engaged with the above-mentioned engaging holes is fixed on the bracket to be freely slidable.

A bracket is provided being supported to be freely rotatable between a pair of supporting frames, a line head is fixed on the bracket through an elastic member, a platen is disposed in a position opposing to the heating element array of the line head being capable of freely approaching to or receding from the platen, a plurality of engaging holes disposed in a direction in which the line head approaches to or recedes from the platen are formed on a facing part of the supporting frame and the bracket on a side, and on the other side an engaging claw is fixed being freely slidable to be selectively engaged with one of the engaging holes.

Further, a bracket is provided being supported by the shaft to be freely rotatable between a pair of supporting frames, a line head is fixed on the bracket through an elastic member, a platen is disposed in a position opposing to the heating element array of the line head being capable of freely approaching to or receding from the platen, an engaging claw on which a plurality of engaging surfaces are formed stepwise in a direction in which the line head approaches to or recedes from the platen is fixed to be freely slidable on the facing portion of the supporting frame and the bracket on a side, and on the other side an engaging hole is formed to be selectively engaged with one of the plurality of engaging surfaces of the engaging claw.

DESCRIPTION OF THE PREFERRED EMBODIMENTS

Figure 1:
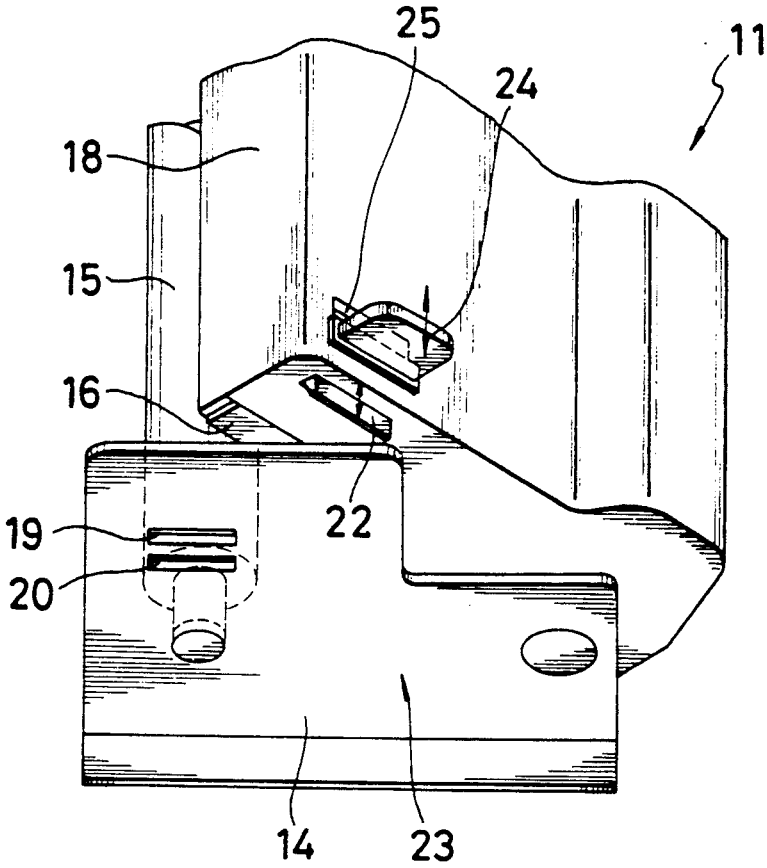
FIG. 1 is a perspective view showing a first embodiment according to the present invention.
Figure 2:
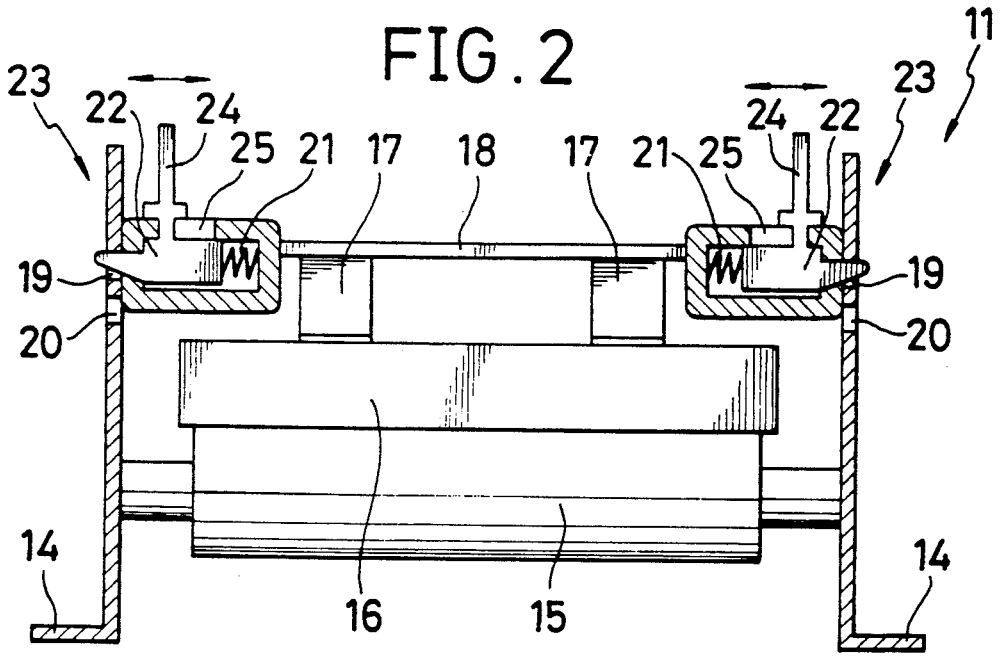
FIG. 2 is a front view of what is shown in FIG. 1.
Figure 3:
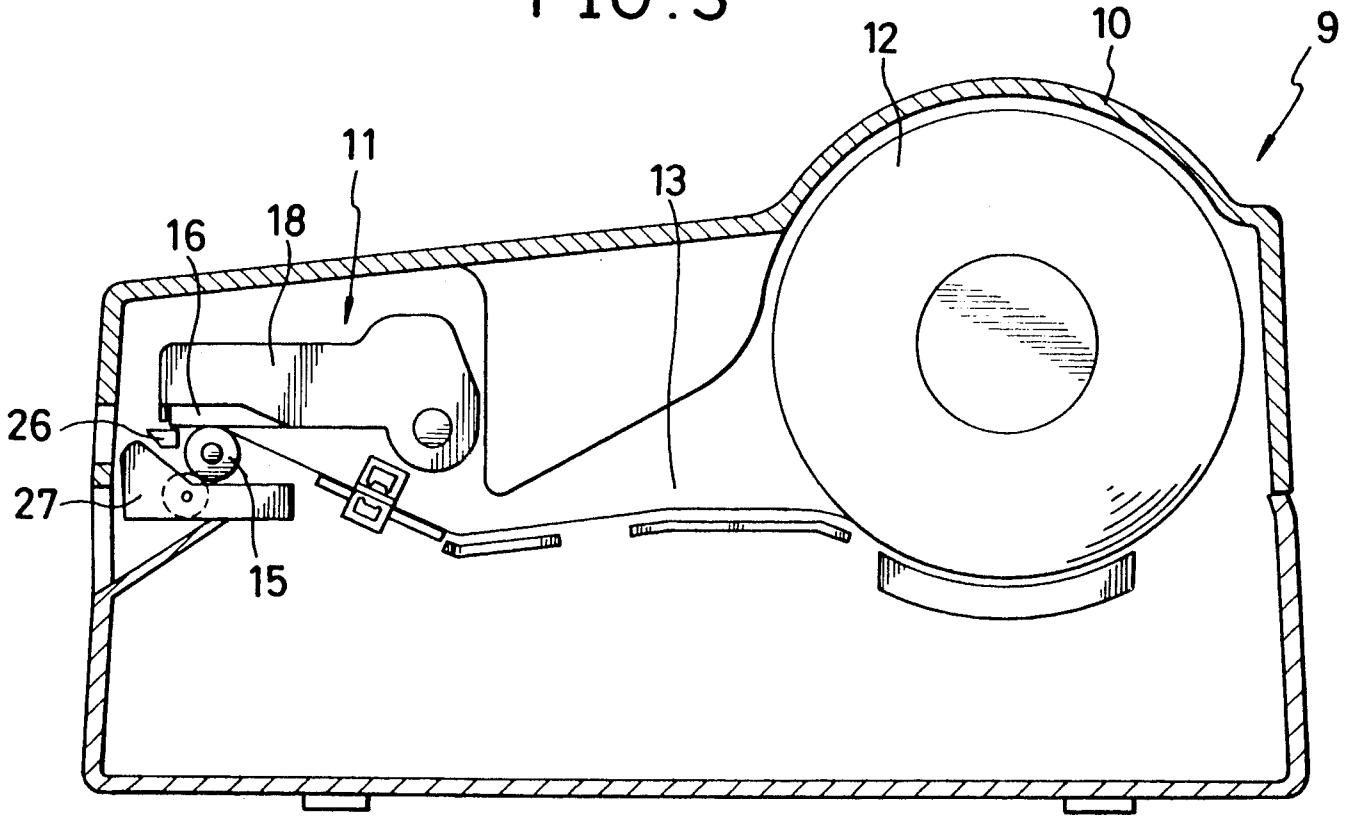
FIG. 3 is a longitudinal sectional side view showing the constitution of the whole.

The first embodiment according to the present invention will be explained based on FIG. 1 to FIG. 3. In a label printer 9, a thermal printer, as shown in FIG. 3, an image printing portion 11 is provided in the front part of a main body housing 10 and in the rear part of it a sheet supplying portion 12 is provided, and the sheet supplying portion has a constitution for supporting recording media such as label sheets or tag sheets wound in a roll shape to be freely rotatable. In the image printing portion 11 which performs image printing on a recording medium 13, as shown in FIG. 1 and FIG. 2, a line head 16 is fixed on the under surface of a bracket 18 through a plate spring 17, the bracket 18 which is supported to be freely rotatable by the rear end portion between a pair of supporting frames 14, and a platen roller 15 opposing to the heating element array of the line head 16 being capable of freely approaching to or receding from the platen roller 15 is supported to be freely rotatable by the shaft between the supporting frames 14. Further, in the image printing portion 11 of the label printer 9, two engaging holes 19 and 20 are formed on each of the pair of supporting frames 14, and engaging claws 22 being energized outward with springs 21 are fixed to be freely slidable on both sides of the bracket 18, and a variable pressure mechanism 23 is formed by an arrangement in which the engaging claws 22 and the engaging holes 19 and 20 are facing each other to be freely engaged or disengaged. These engaging holes 19 and 20 are formed to be thin and long, and the long sides are disposed to be close to each other. In the label printer 9, a manual lever 24 is provided being protruded on the upper surface of the engaging claw 22, and the manual lever 24 is protruded upward from a through hole 25 formed on the upper surface of the bracket 18. In the label printer 9, two engaging holes 19 and 20 formed on the supporting frames 14 are disposed in a direction in which the line head 16 approaches to or recedes from the platen roller 15.

Further, in the label printer 9, in front of the image printing portion 11 having a constitution as described in the above, a label separation portion 26 which separates a label (not shown in a drawing) in bending a pasteboard of a label sheet in a sharp angle can be provided being protruded if desired, and under the label separation portion 26, a pasteboard conveyance device 27 is provided which conveys a pasteboard of a label sheet (not shown in a drawing), a recording medium 13, to discharge it outside.

In the constitution as described in the above, in the label printer 9, the recording medium in the sheet supplier portion 12 is conveyed with a platen roller 15 in the image printing portion 11, and a line head 16 which is pressed by the elastic force of the plate spring 17 toward the platen roller 15 performs image printing on a recording medium 13.

In the label printer 9, label sheets or tag sheets are utilized as recording media 13; since the thickness of a label sheet and that of a tag sheet are different, it is necessary to adjust the pressing force of the line head 16 toward the platen roller in correspondence to the thickness of a recording medium.

In the label printer 9, for example, when a thick label sheet is to be utilized as a recording medium 13, the engaging claw 22 is engaged with the engaging hole 19 in the upper part of the supporting frame 14 to position and hold the bracket 18 in the upper part; in this way, the pressing force to be given by the line head 16 toward the platen roller 15 is decreased by the action of the plate spring 17 under the bracket 18. When a thin tag sheet is to be utilized as a recording medium, the engaging claw 22 is engaged with the engaging hole 20 in the lower part of the supporting frame 14 to position and hold the bracket 18 in the lower part; in this way, the pressing force given by the line head 16 toward the platen roller 15 is increased by the action of the plate spring 17 under the bracket 18.

In such an arrangement, in the label printer 9, since the pressing force between the platen roller 15 and the line head 16 can be varied in two steps corresponding to the thickness of a recording medium to be utilized, high quality image printing is possible on a recording medium such as a label sheet or a tag sheet. Further, in the label printer 9 as described in the above, the pressure variable mechanism 23 to position and hold the bracket 18 for varying the pressure of the line head 16 toward the platen roller is formed with the engaging claw 22 on the bracket 18 which can be freely engaged or disengaged with the holes 19 and 20 on the supporting frame 14; thereby, the positioning and holding of the bracket 18 is certain and the bracket 18 is prevented from the displacement caused by the external disturbances as vibration, etc.

In the label printer in the present embodiment, the engaging holes 19 and 20 are formed on the supporting frames 14 and the pressure variable mechanism 23 is formed in incorporating the engaging claw 22 inside the bracket 18, and the width of the pressure variable mechanism 23 is made equal to that of the line head 16 by providing the manual lever 24 for controlling the pressure variable mechanism 23 being protruded from the upper surface of the bracket 18, which makes it possible to realize miniaturization and light weight of the printer. When it is not important to make the printer small in size and light in weight, it is possible to form the engaging holes 19 and 20 on the bracket 18 and to form a pressure variable mechanism (not shown in a drawing), in which the engaging claw 22 is fixed, on the supporting frame 14.

Next, the second embodiment according to the present invention will be explained based on FIG. 4 to FIG. 6. A label printer in the present embodiment, a thermal printer, has a similar constitution as a whole to that of a label printer 9 shown in FIG. 3.

Figure 4:
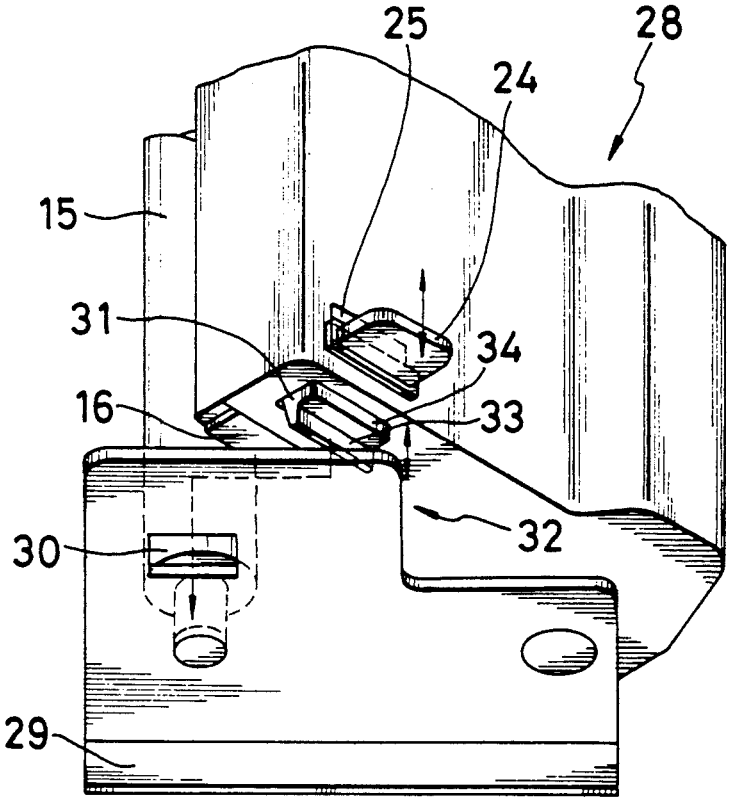
FIG. 4 is a perspective view showing a second embodiment according to the present invention.
Figure 5:
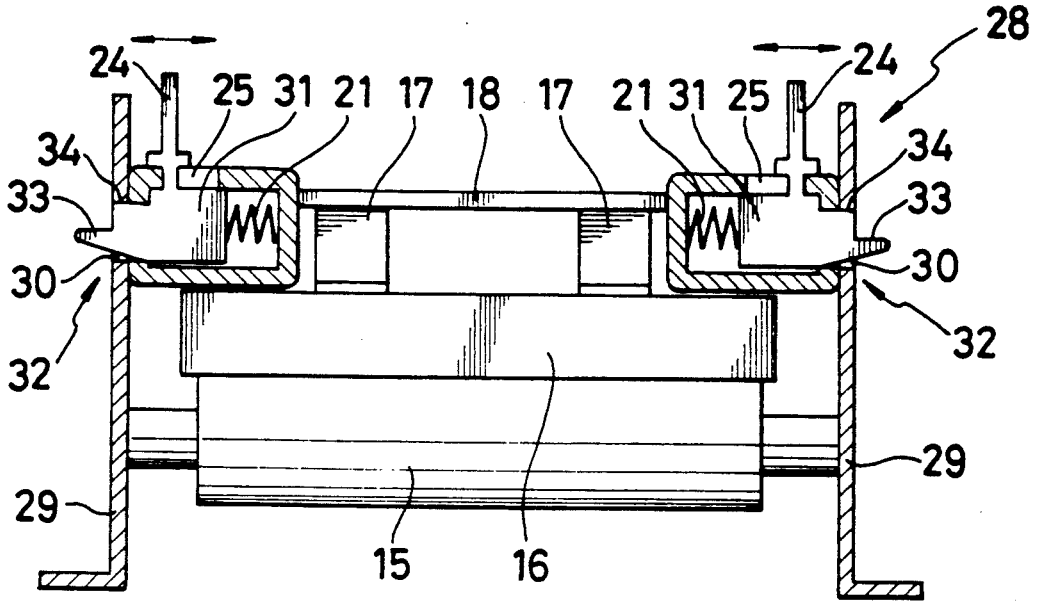
FIG. 5 is a front view.

In an image printing portion 28 of a label printer, as shown in FIG. 4 and FIG. 5, an engaging hole 30 is formed on each of a pair of supporting frames 29, and engaging claws 31 energized outward by springs 21 are fixed to be freely slidable on both sides of a bracket 18, and a pressure variable mechanism 32 is formed in making the engaging claw 31 and the engaging hole 30 face each other to be freely engaged or disengaged. In this label printer, the tip part of the engaging claw 31 is formed to be stepwise, and engaging surfaces 33 and 34 are positioned stepwise in the direction in which the line head 16 approaches to or recedes from the platen roller 15 and one of them is to be selectively engaged with an engaging hole 30.

In the constitution as described in the above, the label printer, similar to the above-mentioned label printer 9, a line head 16 being pressed and held with a plate spring 17 against a platen roller 15 performs specified printing on a recording medium 13.

Figures 6A, 6B:
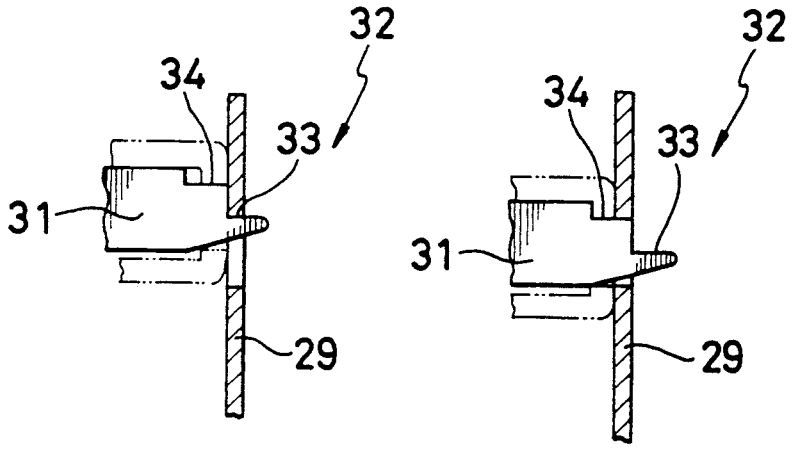
FIG. 6 is a longitudinal sectional front view showing an enlarged view of an essential part.

In the image printing portion 28 in the label printer when the pressing force of the line head 16 toward the platen roller 15 is varied corresponding to the thickness of a recording medium 13, as shown in FIG. 6(*a*), the pressing force is decreased in positioning and holding the bracket 18 in a upper part in making a low engaging surface 33 of the engaging claw engage with the engaging hole 30 of the supporting frame 29, or as shown in FIG. 6(*b*), the pressing force is increased in positioning and holding the bracket 18 in a low part in making a high engaging surface 34 of the engaging claw 31 engage with the engaging hole 20 of the supporting frame 29.

As described in the above, the label printer, similar to the above-mentioned label printer 9, the pressing force between the platen roller 15 and the line head 16 can be varied in two steps corresponding to the thickness of a utilized recording medium 13, so that it is made possible to perform image printing of high quality on a recording medium 13 such as a label sheet or a tag sheet. In the label printer, the pressure variable mechanism 32 which positions and holds the bracket 18 for making the pressing force of the line head 16 toward the platen roller 15 variable is formed with an engaging claw 31 of the bracket 18 being freely engaged or disengaged with the engaging hole 30 of the supporting frame 29; thereby the positioning and the holding of the bracket 18 is certain and the bracket 18 is prevented from the displacement caused by the external disturbances such as vibration.

In the present invention as described in the above, a bracket is provided being supported by the shaft to be freely rotatable between a pair of supporting frames, a line head is fixed on the bracket through an elastic member, a platen is disposed in a position opposing to a heating element array of the line head being capable of freely approaching to or receding from the platen, an engaging hole is formed on each of the supporting frames and an engaging claw is fixed to be freely slidable on the bracket to be engaged with the engaging hole; therefore, an opening side of the bracket is completely opened and the bracket can be rotated in a wide range, which makes it possible to make the distance between the platen and the line head large, the change of a recording medium easy and the workability good.

In the present invention, a bracket is provided being supported by the shaft to be freely rotatable between a pair of supporting frames, a line head is fixed on the bracket through an elastic member, a platen is disposed in a position opposing to the heating element array of the line head being capable of freely approaching to or receding from the platen, a plurality of engaging holes disposed in the direction in which the line head approaches to or recedes from the platen are formed on a facing part of a supporting frame and the bracket on one side, and on the other side an engaging claw is fixed to be freely slidable to be engaged selectively with one of the engaging holes; these engaging holes and the engaging claw are able to position and hold the bracket more securely in comparison with the case where a polygon cam, etc. are used. Therefore, there is an effect that a thermal printer can be realized which can perform image printing of good quality on recording media having several kinds of thicknesses.

Further, in the present invention, a bracket is provided being supported by the shaft to be freely rotatable between a pair of supporting frames, a line head is fixed on the bracket through an elastic member, a platen is disposed in a position opposing to the heating element array of the line head being capable of freely approaching to or receding from the platen, an engaging claw on which a plurality of engaging surfaces are formed stepwise in a direction in which the line head approaches to or receding from the platen is fixed to be freely slidable on a facing part of the supporting frame and the bracket on one side and on a facing part on the other side an engaging hole is formed with which one of the plurality of engaging surfaces of the engaging claw is to be selectively engaged; these engaging holes and an engaging claw can position and hold the bracket more certainly in comparison with the case where a polygon cam, etc. are used. Therefore, there is an effect that a thermal printer can be realized which can perform image printing of good quality on recording media having several kinds of thicknesses.

Figure 7:
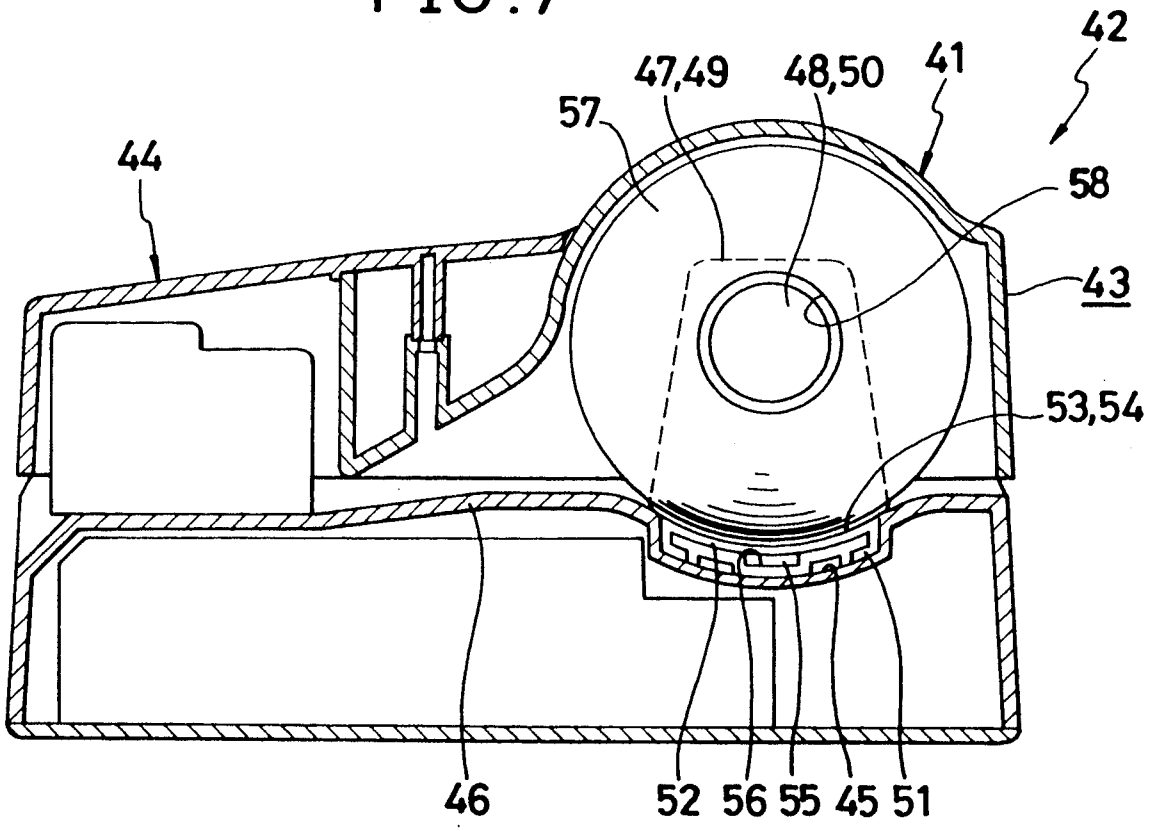
FIG. 7 is a longitudinal sectional side view showing a third embodiment according to the present invention.

Next, the third embodiment according to the present invention will be explained based on FIG. 7 and FIG. 8. A label holding portion 41, a recording medium holding unit, as shown in FIG. 7, is formed in the rear part of a main body housing 43 as a part of a label printer 42, and in the front part of the main body housing 43 a printer portion 44 is formed communicating with the label holding portion 41.

Figure 8A:
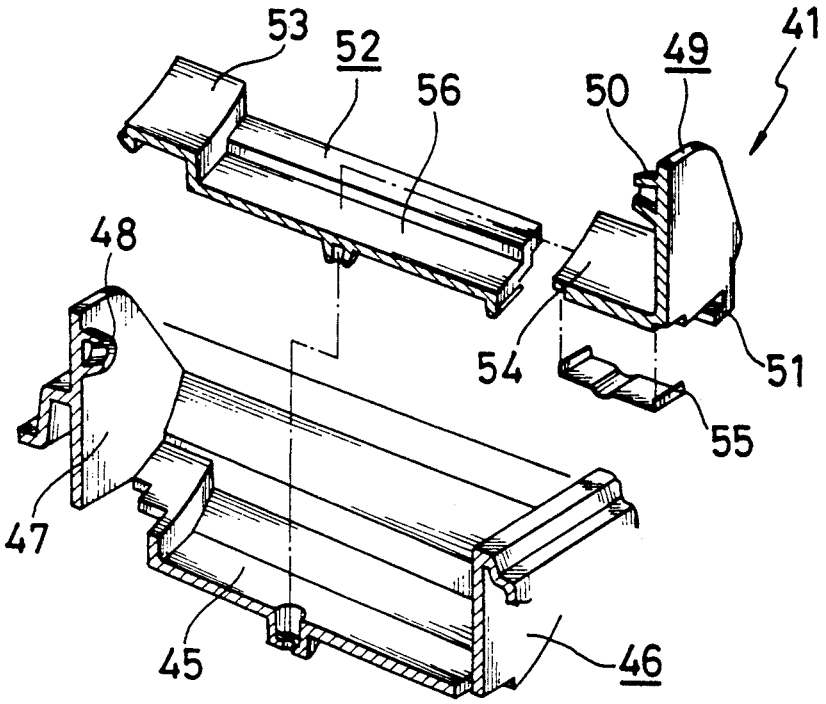
FIG. 8 is a perspective view showing an assembling process of an essential part.
Figure 8B:
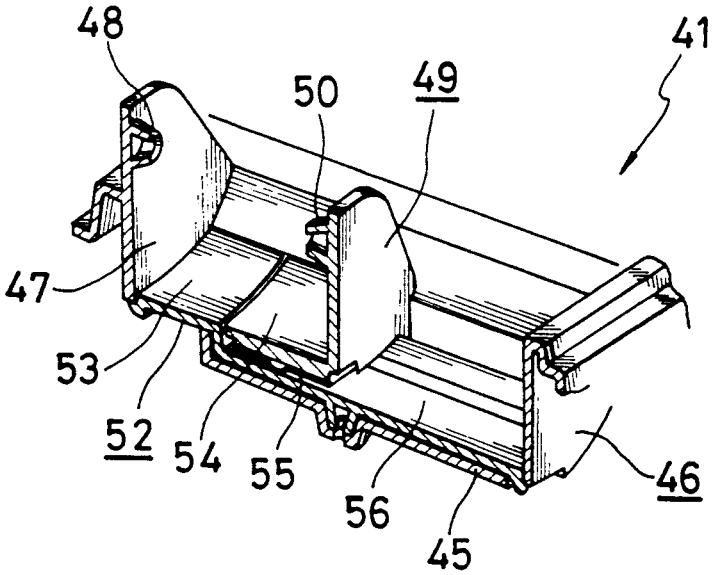
Figure 9:
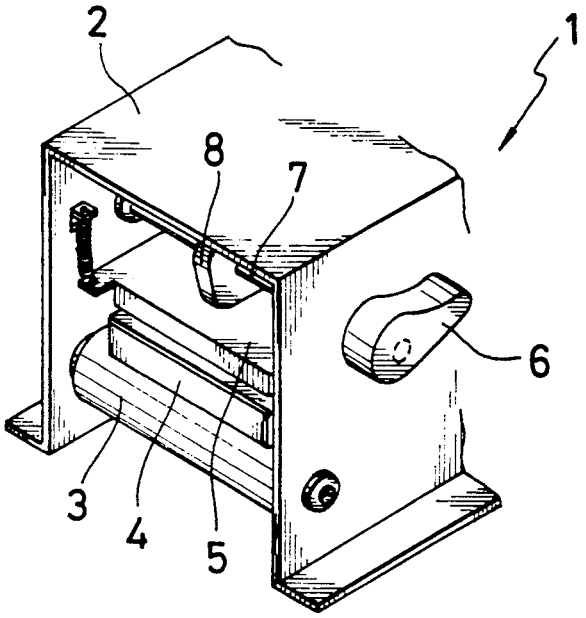
FIG. 9 is a perspective view showing a conventional example.

In the label holding portion 41 as shown in FIG. 8, a fixed guide 47, a guide member, stands at an end on a side of a main body base 46 having a depressed groove 45 of a rail shape being thin and long in the lateral direction at the bottom of it, and a tapered supporting shaft 48 is provided being protruded on the inside surface of the fixed guide 47. A movable guide 49, a guide member and a holding member, is provided to be opposing to the fixed guide 47 of the main body base 46, and on the inside surface of it a tapered supporting shaft 50 is provided being protruded and arms 51 having L-shaped sections are formed on the front and rear peripheral parts of the bottom surface. The arms 51 of the movable guide 49 are freely slidably engaged with the front and rear peripheral parts of the bottom portion cover 52, a holding member, fixed on the depressed groove 45 on the main body base 46, and placing portions 53 and 54 being bent to circular shapes are formed in an end part of the bottom portion cover 52 under the fixed guide 47 and in the lower part on the inside surface of the movable guide 49. In the label holding portion 41, a bent plate spring 55 is fixed on the bottom surface of the movable guide 49, and the plate spring 55 is positioned in the depressed groove 56 formed on the upper surface of the bottom portion cover 52. In the label holding part 41, when a label sheet 57, a recording medium, wound in a roll shape is placed on the placing portions 53 and 54 of the fixed guide 47 and the movable guide 49, the tip parts of the tapered supporting shafts 48 and 50 of the guides 47 and 49 are arranged to face the central openings 58 on both end parts of the label sheet 57.

In the constitution as described in the above, in the label printer 42, the label sheet 57 being supported with tapered supporting shafts 48 and 50 of the label holding portion 41 to be freely rotatable is pulled out and supplied to the printer portion 44, and in the printer portion 44 specified image printing is performed on the label sheet 57.

The work process when a label sheet 57 is set in the label holding portion 41 of the label printer 42 will be explained in the following. At first, the upper side of the main body base 46 is opened in rotating the upper panel of the main housing 43 upward centering a hinge at the rear end of it (not shown in a drawing), and the movable guide 49 is detached from the fixed guide 47 corresponding to the width of the label sheet 57, and in this state, the label sheet 57 is placed on the placing portions 54 and 53 of the movable guide 49 and the bottom portion cover 52. In this state, the movable guide 49 is made to slide toward the fixed guide 47, then the tapered supporting shafts 48 and 50 of the guides 47 and 49 are engaged with the central openings of the label sheet 57, and when the guides 47 and 49 are further approached to each other, the label sheet 57 is raised following the slope of the tapered supporting shafts 48 and 50 and is supported to be freely rotatable in a separated state from the placing portions 53 and 54.

In the label holding portion 41, the setting work of the label sheet 57 is made so simple as to complete by only a process to place the label sheet on the placing portions 53 and 54 and slide the movable guide 49, and there is no need to insert a shaft manually into an central opening of a label sheet, which has been performed in a conventional recording medium holding unit. Moreover, in the label sheet holding portion 41, the set label sheet 57 is supported to be freely rotatable with tapered shafts 48 and 50 being different from a conventional case where a label sheet is pulled out in a state where the label sheet is placed on the placing portions 53 and 54; therefore, the friction resistance when it is pulled out is made very small and the surface of the label sheet 57 is prevented from being stained.

In the label holding portion 41, a plate spring 55 is inserted by pressing into the gap between the bottom portion cover 52 and the movable guide 49, which prevents the movable guide 49 from unnecessary movements being fixed to be freely slidable.

In the label printer 41 in the present embodiment, an example is shown in which one of the guides 47 and 49 is fixed and the other is made to be freely slidable; the present invention, however, is not limited to the above-mentioned constitution, and it is also possible to make both guides 47 and 49 to be freely slidable.

What is claimed is:

1. A thermal printer comprising: a bracket supported by a shaft so as to be freely rotatable between a pair of supporting frames; a line head fixed on the bracket through an elastic member; a platen disposed in a position opposing to a heating element array of the line head so as to be freely movable toward or away from the platen; at least one engaging hole formed on at least one of said supporting frames so as to face a second engaging hole formed on an end portion of the bracket; and an engaging claw slidably mounted on the bracket, said engaging claw being slidable for engaging with the second engaging hole in the bracket and for selectively engaging with the at least one engaging hole formed on the at least one supporting frame.

2. A thermal printer as claimed in claim 1, wherein a manual lever is formed on the engaging claw and protrudes upward from the bracket.

3. A thermal printer as claimed in claim 1, comprising two of said engaging claws, each of said engaging claws being fixed on both sides of the bracket.

4. A thermal printer as claimed in claim 1, comprising two of said engaging claws, each of said engaging claws being fixed on the bracket and respectively energized in an outward direction by springs.

5. A thermal printer comprising: a bracket supported by a shaft so as to be freely rotatable between a pair of frames; a line head fixed on the bracket through an elastic member; a platen disposed in a position opposing to a heating element array of the line head being so as to be freely movable to or away from the platen; a plurality of engaging holes disposed along a direction of movement of the line head to or from the platen, said plurality of engaging holes being formed on at least one of said supporting frames so as to face an engaging hole formed on an end portion of said bracket; and an engaging claw slidably mounted on the bracket for engaging with the engaging hole on the bracket and for selectively engaging with one of said plurality of engaging holes formed on the at least one supporting frame.

6. A thermal head as claimed in claim 5, wherein said engaging holes are formed thin and long and are disposed such that long sides of said engaging holes are close to each other.

7. A thermal printer comprising: a bracket being supported to be freely rotatable between a pair of supporting frames; a line head fixed on the bracket through an elastic member; a platen disposed in a position opposing to a heating element array of the line head so as to be freely movable in a direction toward or away from the platen; an engaging claw having a plurality of engaging surfaces being formed stepwise in a direction of movement of the line head to or from the platen, said engaging claw being formed to be freely slidably mounted on an end portion of said bracket which faces at least one of said supporting frames; and an engaging hole formed on at least one of said supporting frames, said engaging claw being slidable for permitting one of the plurality of engaging surfaces on the engaging claws to be selectively engaged with the engaging hole.

* * * * *